US007755558B2

(12) United States Patent
Ueda et al.

(10) Patent No.: US 7,755,558 B2
(45) Date of Patent: Jul. 13, 2010

(54) ANTENNA COIL

(75) Inventors: Hozumi Ueda, Tokyo (JP); Tatsumi Nishino, Tokyo (JP); Takahide Kitahara, Aichi-ken (JP)

(73) Assignee: Denso Corporation, Aichi-Ken (JP)

( * ) Notice: Subject to any disclaimer, the term of this patent is extended or adjusted under 35 U.S.C. 154(b) by 570 days.

(21) Appl. No.: 11/785,510

(22) Filed: Apr. 18, 2007

(65) Prior Publication Data

US 2008/0036672 A1 Feb. 14, 2008

Related U.S. Application Data

(62) Division of application No. 10/506,565, filed on Aug. 5, 2005, now abandoned.

(51) Int. Cl.
*H01Q 7/08* (2006.01)
*H01Q 21/00* (2006.01)
*H01Q 11/12* (2006.01)

(52) U.S. Cl. ..... 343/788; 343/728; 343/742; 343/867

(58) Field of Classification Search ..... 343/713, 343/728, 742, 787, 788, 842, 866, 867
See application file for complete search history.

(56) References Cited

U.S. PATENT DOCUMENTS

| | | | | |
|---|---|---|---|---|
| 2,297,466 | A | 9/1942 | Funke et al. | |
| 4,210,859 | A | 7/1980 | Meretsky et al. | |
| 5,047,715 | A | 9/1991 | Morgenstern | |
| 5,281,941 | A | 1/1994 | Bernstein | |
| 5,640,092 | A | 6/1997 | Motazed et al. | |
| 6,150,986 | A | 11/2000 | Sandberg et al. | |
| 6,407,677 | B1 | 6/2002 | Avenel et al. | |
| 6,563,474 | B2 | 5/2003 | Nantz et al. | |
| 6,577,284 | B1 * | 6/2003 | Conti | 343/788 |
| 6,940,461 | B2 * | 9/2005 | Nantz et al. | 343/713 |
| 7,042,411 | B2 | 5/2006 | Yagi et al. | |
| 7,123,206 | B2 * | 10/2006 | Hess et al. | 343/788 |
| 2003/0222829 | A1 | 12/2003 | Kitahara et al. | |

(Continued)

FOREIGN PATENT DOCUMENTS

EP 0 576 187 A1 12/1993

(Continued)

OTHER PUBLICATIONS

English-language International Search Report dated Nov. 12, 2002, issued in counterpart International Application No. PCT/JP02/07892.

(Continued)

*Primary Examiner*—Shih-Chao Chen
(74) *Attorney, Agent, or Firm*—Finnegan, Henderson, Farabow, Garrett & Dunner, L.L.P.

(57) ABSTRACT

The size of an antenna coil is reduced, and it is possible to prevent a lowering of the reception sensitivity due to a difference of the arrangement position of the antenna coil. On a winding frame of a ferrite core, a first coil and a second coil are wound in such a manner that their winding axes orthogonally intersect each other. A third coil is wound around an outer circumference of the first coil and the second coil in such a manner that the third coil's winding axis orthogonally intersects the winding axes of the first coil and the second coil.

2 Claims, 10 Drawing Sheets

U.S. PATENT DOCUMENTS

| | | | |
|---|---|---|---|
| 2004/0061660 | A1 | 4/2004 | Yoshida et al. |

FOREIGN PATENT DOCUMENTS

| | | | |
|---|---|---|---|
| EP | 1 014 596 | A1 | 6/2000 |
| EP | 1 376 762 | A1 | 1/2004 |
| GB | 2 326 769 | A | 12/1998 |
| JP | 44-29903 | | 12/1969 |
| JP | 5-34708 | | 5/1993 |
| JP | 2501867 | | 4/1996 |
| JP | 8-293725 | | 11/1996 |
| JP | 2000-196353 | | 7/2000 |
| JP | 2001-297918 | | 10/2001 |
| JP | 2004-15168 | | 1/2004 |
| WO | WO 01/41319 | A1 | 6/2001 |

OTHER PUBLICATIONS

Office Action from the European Patent Office in corresponding European Patent Application No. 02 755 774.3-1248, dated Aug. 6, 2007.

Summons to Attend Oral Proceedings from European Patent Office in corresponding European Patent Application No. 02 755 774.3-1248, dated Feb. 20, 2009.

Decision to Refuse from the European Patent Office in corresponding European Patent Application No. 02 755 774.3-1248, dated Jul. 17, 2009.

* cited by examiner

X

Y

Z

X

Y

Z

ANTENNA COIL

This application is a division of application Ser. No. 10/506,565, filed under 35 U.S.C. §371 on Aug. 5, 2005 now abandoned, which claims the benefit of priority to Japanese Patent Application No. 2002-58835, filed on Mar. 5, 2002, the entire disclosures of which are incorporated herein by reference.

TECHNICAL FIELD

The present invention relates to a small-sized antenna coil used in, for example, the receptor of a keyless entry system and anti-theft device to open and close locked and unlocked cars by remote control.

PRIOR ART

Conventionally, bar antenna coils wound lengthwise along a bar-shaped ferrite core are frequently used as antenna coils in the receptors of this sort of keyless entry system and anti-theft device.

In other words, a bar antenna coil structured as discussed above has directionality whereby reception sensitivity is highest to wavelengths incident from the direction parallel to the lengthwise axis of the ferrite core and lowest to wavelengths incident from the direction orthogonal to the lengthwise bearing of the ferrite core, and reception sensitivity drops a great deal depending where said bar antenna coil is located. It is thus rare that said bar coil is used on its own. Ordinarily, the overall reception sensitivity of the antenna coil is increased by arranging multiple bar antenna coils along the X-axis and Y-axis of the receptor's circuit substrate.

However, when multiple antenna coils are arranged in this way along the X-axis and Y-axis of the receptor's circuit substrate, the surface area occupied by the antenna coil component in the aforementioned circuit substrate rises and thus the device itself that is equipped with the antenna coil must be made large, which is counter to the notion of minimizing device size. Furthermore, there are cases where individual bar antennas interfere with each other and the anticipated reception sensitivity does not materialize.

The present invention was created to resolve the sorts of problems discussed above that conventional antenna coils present, its aim being to supply an antenna coil whereby smaller sizes and reduced weight can be devised. Another aim is to supply an antenna coil whereby favorable reception sensitivity can be obtained with minimal interference.

INVENTION DISCLOSURE

The present invention supplies an antenna coil characterized in that firstly, to resolve the aforementioned problems, the first coil and the second coil are wound in the core winding rod component such that their respective coil axes are orthogonal.

The second invention is characterized in that there is provided a third coil wound so as to surround the aforementioned first coil and second coil and whereby its coil axis is orthogonal to the aforementioned second coil.

The third invention is characterized in that in the aforementioned second invention, the aforementioned third coil is wound around a coil rod having insulation properties.

In the fourth present invention, the respective coils in the aforementioned first through third inventions are characterized in that the respective numbers of loops in the coils are adjusted so that the electric field intensity and magnetic field intensity generated by the respective coils are about equal.

The fifth present invention is characterized in that the related antenna coil has a flat columnar base component, a first coil wound such that the axis is the X-axis of the aforementioned base component, a second coil wound such that the axis is the Y-axis of the aforementioned base component, and a third coil wound such that the axis is the Z-axis of the aforementioned base component, and at least part of the respective winding paths whereon are wound the aforementioned first, second, and third coils are grooves.

The sixth present invention is characterized in that in the antenna coil, the aforementioned base component is flat and more or less a right angled parallelepiped, and tabs are placed in the eight corners of the bases of the aforementioned parallelepiped. The first sides on the aforementioned tabs are arranged facing the lateral wall of the first groove wherein is wound the aforementioned first coil. The second sides of the aforementioned tabs are arranged facing the lateral wall of the second groove component wherein is wound the aforementioned second coil. The part sandwiched by the surfaces of the aforementioned tabs is arranged facing the lateral wall of the third groove component wherein is wound the aforementioned third coil.

The antenna coil related to the seventh present invention is characterized in that the flat configuration of the aforementioned tabs is shaped like a quarter-circle fan.

The antenna coil related to the eighth invention is characterized in that one of the four ends in the various aforementioned coils is connected to a respective common terminal, and the remaining three ends are connected to different terminals, thereby providing four terminals.

The antenna coil related to the ninth invention is characterized in that the terminal on the side where the winding of the aforementioned first coil ends, the terminal on the side where the winding of the aforementioned second coil starts, and the terminal on the side where the winding of the aforementioned third coil starts are connected to a common terminal.

A BRIEF EXPLANATION OF THE FIGURES

EMBODIMENTS OF THE PRESENT INVENTION

Figure 1:
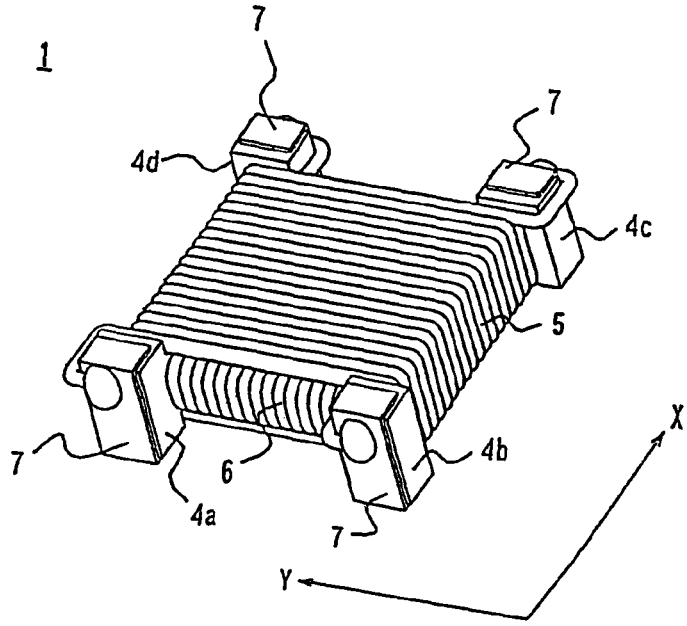
FIG. 1 is a perspective view of a first embodiment of the antenna coil of the present invention.
Figure 2:
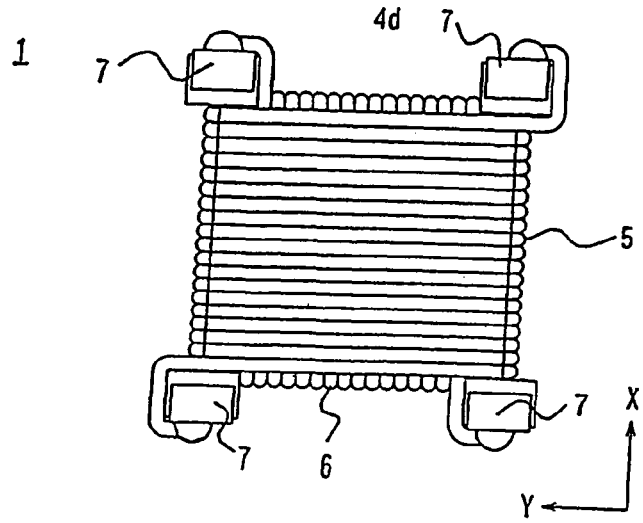
FIG. 2 is a top-down view of the aforementioned antenna coil.
Figure 3:
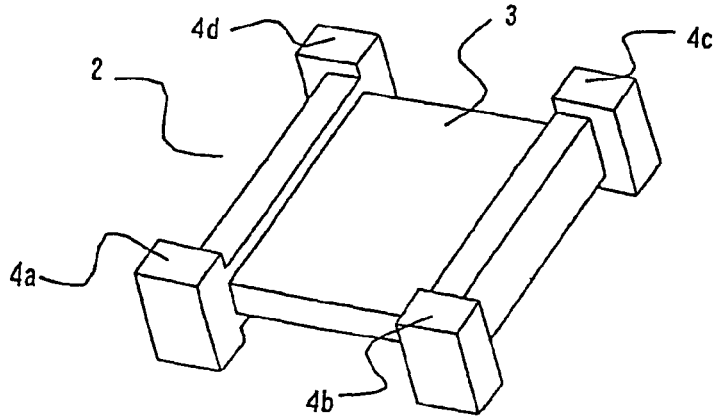
FIG. 3 is a perspective view of one example of the configuration of a ferrite core used in the aforementioned antenna coil.

Next, the present invention will be explained using embodiments of the present invention. In FIGS. 1 through 3, (1) depicts a small-sized antenna coil comprising a ferrite core (2) formed of a square shaped winding component (3) and protrusions from the four corners and is integrally formed with protrusions (4*a*), (4*b*), (4*c*) and (4*d*) wherein winding stoppers and electrode attachment components are superimposed, and of a first coil (5) wound onto the two facing sides of winding component (3) such that the winding axis is parallel to the X-axis of the ferrite core (2) and a second coil (6) whereby wound onto the two other facing sides of the winding component (3) such that its axis is parallel to the Y-axis of said ferrite core. Namely, the winding axis of the first coil (5) and the winding axis of the second coil (6) become orthogonal on a level plane. Moreover, the respective winding start ends and winding finish ends of the first coil (5) and the second coil (6) are connected to the circuit substrate (not shown) of the electronic device by way of metal terminal plates attached to the protrusions (4*a*), (4*b*), (4*c*), (4*d*) of the ferrite core (2) and by way of electrode component (7) made of solder.

Figure 4:
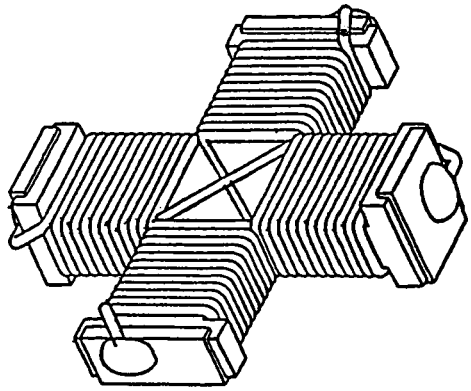
FIG. 4 is a perspective view of a second embodiment of the antenna coil of the present invention.
Figure 5:
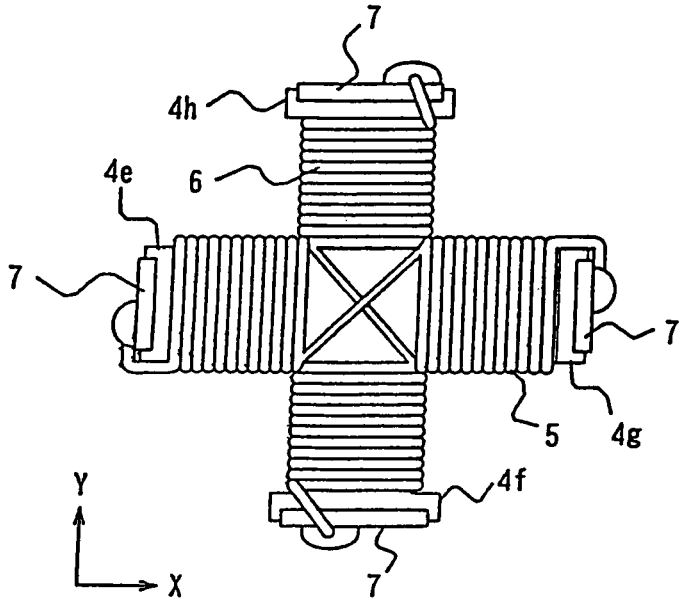
FIG. 5 is a perspective view of the configuration of the ferrite core used in the top-down figure of FIG. 4.
Figure 6:
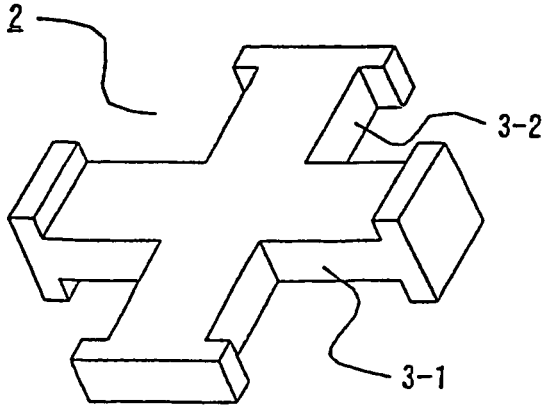
FIG. 6 is a perspective view of the shape of the ferrite core used in FIGS. 4 and 5.

As for the second embodiment depicted in FIG. 4 and FIG. 5, the configuration of the ferrite core (2) in the example shown is cruciform. The first coil (5) is wound at site 3-1, an X-axis extension of coil component (3). Its starting end and ending end are connected to the electrodes formed in the protrusions (4*e*), (4*g*), respectively. Moreover, the second coil (6) is wound at site 3-2 on a Y-axis extension of the winding coil component (3). Its winding start end and winding finish end are connected, respectively, to electrodes (7) formed in protrusions (4*f*), (4*h*).

Figure 7:
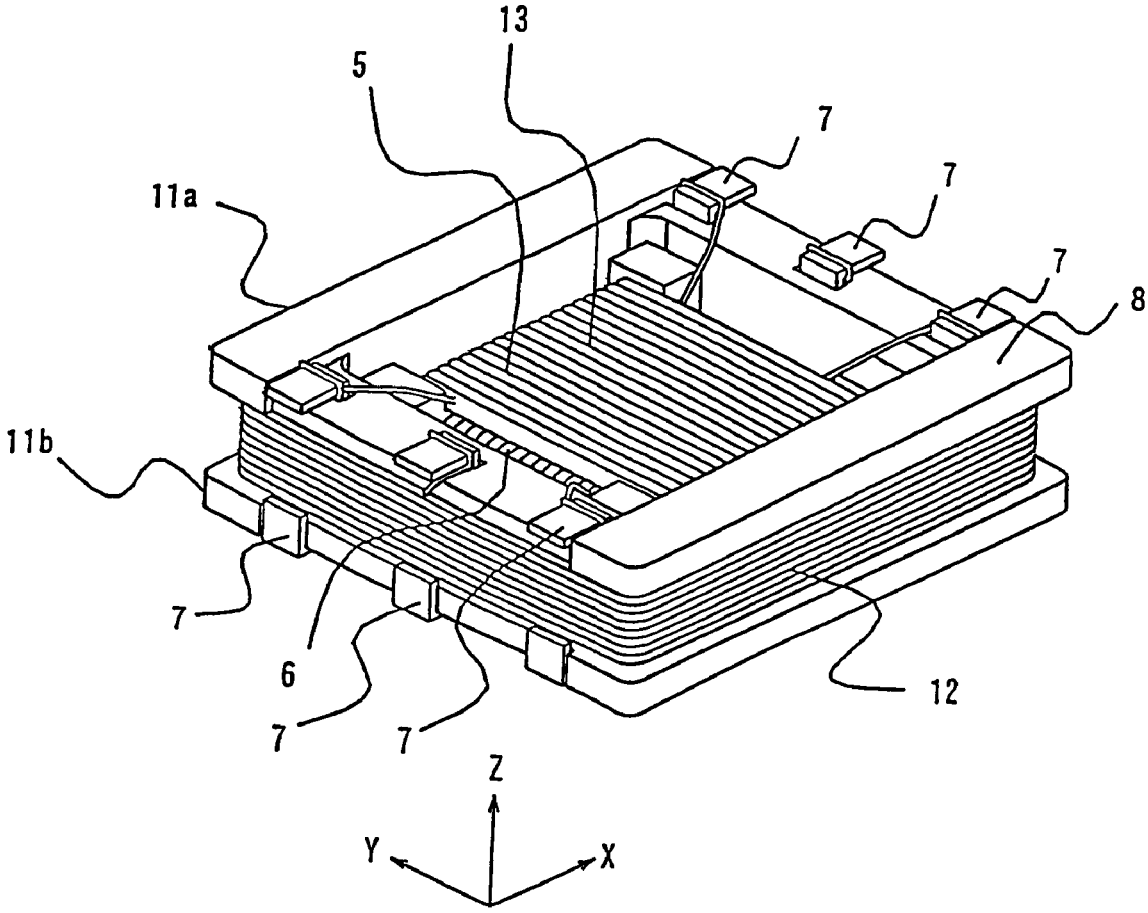
FIG. 7 is a perspective view of a third embodiment of the antenna coil of the present invention.
Figure 8:
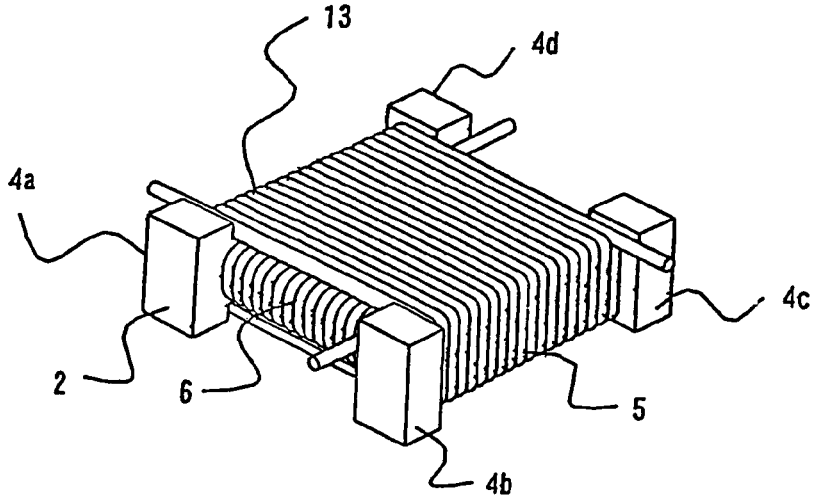
FIG. 8 is a partial cutaway of the embodiment in FIG. 7.
Figure 8:
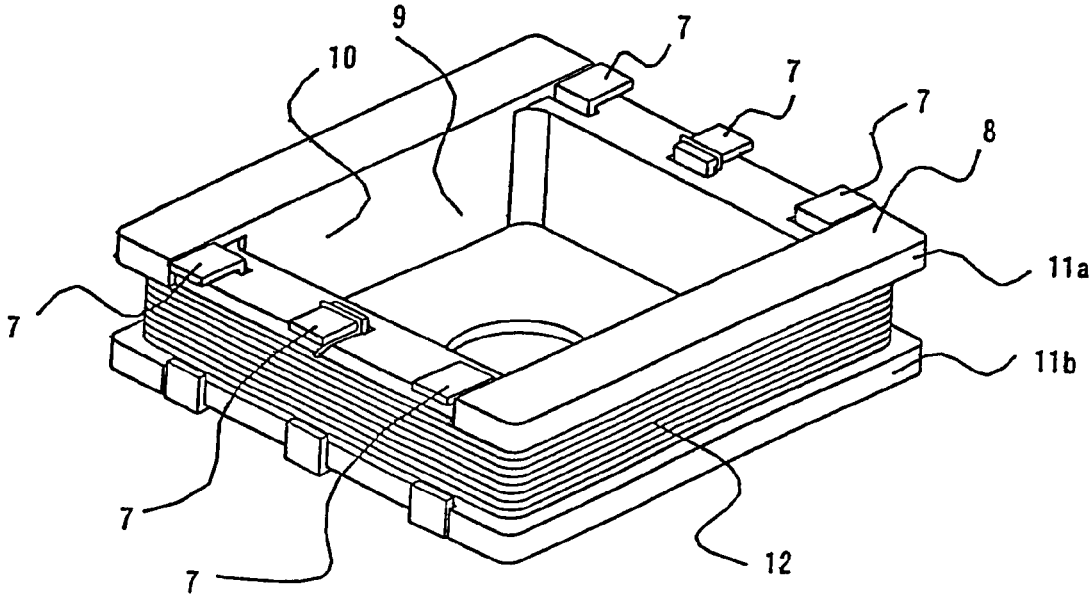

FIG. 7 and FIG. 8 show a third embodiment that differs from the two aforementioned embodiments. (8) is a winding rod made of insulating resin, etc. in whose center area is formed a hole and indentation (9). Rim parts (11*a*), (11*b*) are formed that protrude parallel to the periphery at the top and bottom of the wall component (10). (12) is a third coil wound on the outer circumference of the wall component (10) of the winding rod (8) so that the winding axis is parallel to the Z-axis. Then, a first antenna coil component (13) like that shown in Embodiment 1 is arranged flatly in the hole or indentation (9) of the winding bar (8). That is, the first antenna coil (13) comprises a ferrite core (2) formed integrally with protrusions (4*a*), (4*b*), (4*c*), (4*d*) that serve as flat angular winding components and as winding stoppers, a first coil (5) wound onto two facing sides of the winding component of the ferrite core such that the winding axis is parallel to the X-axis, and a second coil (6) wound onto the other two facing sides of the aforementioned winding component whose winding axis is parallel to the Y-axis. Moreover, the respective winding start ends and winding stop ends of the first coil (5) and the second coil (6) of the first antenna coil (13), and the winding start end and the winding stop end of the third coil comprising the second antenna coil, are connected to electrodes (7) arranged on the facing sides of edge components (11*a*), (11*b*) of the respective winding bars (8). Hence, the third coil (12) comprising the second antenna coil component is arranged to surround the first antenna coil component (13) by way of the wall (10) of winding bar (8). Moreover, the winding axis is arranged to be orthogonal to the aforementioned first coil (5) and second coil (6).

In the first embodiment that FIG. 1 and FIG. 2 show, and in the second embodiment that FIG. 4 and FIG. 5 show, the number of loops in the respective coils is adjusted so the electrical field intensity generated by the first coil (5) and the second coil (6) are approximately identical, and the first coil (5) and the second coil (6) form respectively independent tuning circuits. The various tuning circuits are connected to a high-frequency modulation circuit. When said high frequency modulation circuit selectively modulates the stronger output signal of the various tuning circuits, the electrical field intensity and the magnetic field intensity are more intense relative to the electromagnetic waves incident from the X-axis bearing of the antenna coil (1). Thus, the tuning signal of the tuning circuit on the first coil (5) side is amplified by the high frequency amplification circuit. Moreover, because the electrical field intensity and magnetic field intensity evoked by the coil (6) are more intense relative to the electromagnetic waves incident from the Y-axis of the antenna coil (1), the tuning signal of the tuning circuit in the second coil (6) side is amplified by the high frequency modulation circuit. In this way, the two embodiments depicted by FIG. 1 and FIG. 2, and FIG. 4 and FIG. 5, can provide favorable reception sensitivity to electromagnetic waves in the direction level with the plane formed by the X-axis and the Y-axis of the antenna coil (1).

Furthermore, in the third embodiment depicted by FIG. 7 and FIG. 8, the number of loops in the respective coils is adjusted just as described above so that the electric field intensity and the magnetic field intensity evoked, respectively, by the first coil (5) and second coil (6) that form the first antenna coil component (13), and by the third coil (12) that forms the second antenna coil, are approximately equal. Moreover, when the first coil (5), the second coil (6), and the third coil (12) form respectively independent tuning circuits, the various tuning circuits are connected to a high frequency modulation circuit, and said high frequency modulation circuit selectively modulates the more intense output signal of the various tuning circuits. Said high frequency modulation circuit selectively modulates the output signal of the tuning circuit forming the first coil (5) relative to the electromagnetic waves incident from the X-axis, the output signal of the tuning circuit forming the second coil (6) relative to the electromagnetic waves incident from the Y-axis, and the output signal of the tuning circuit forming the third coil (12) relative to the electromagnetic waves incident from the Z-axis. Thus, in the present embodiment, antenna coil (1) improves reception sensitivity not only in the direction level with the plane formed by the X-axis and the Y-axis, but also to electromagnetic waves incident from the Z-axis orthogonal to the aforementioned level plane.

Figure 9:
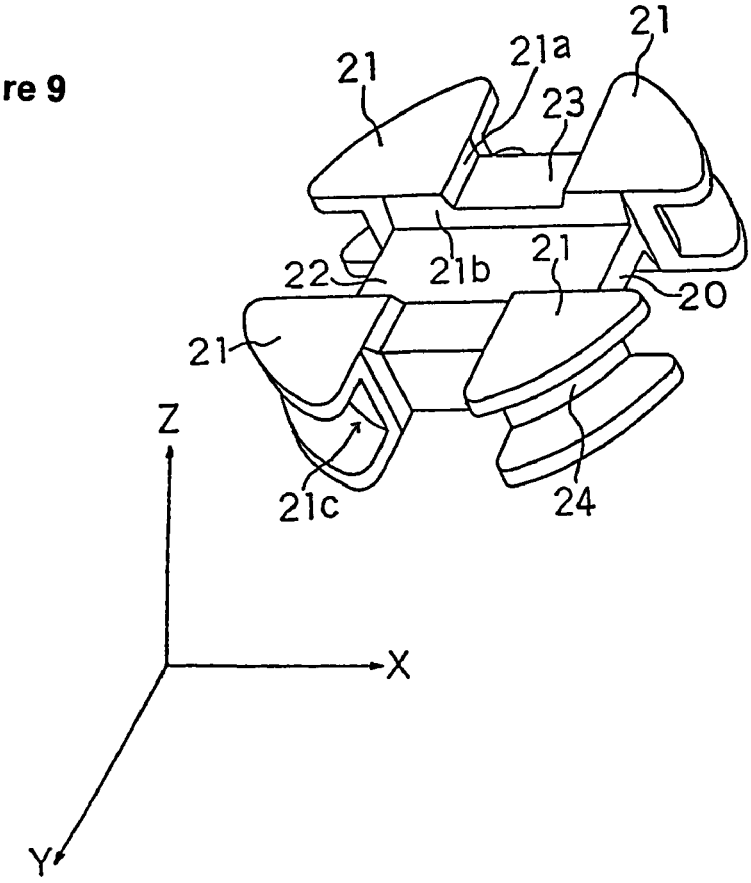
FIG. 9 is a perspective view of the base component of an antenna coil related to the fourth embodiment.
Figure 10:
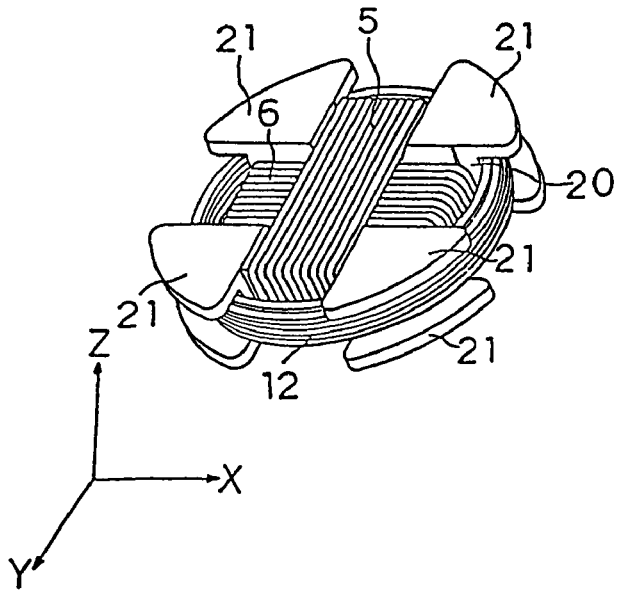
FIG. 10 is a perspective view of a base component with wound coil in an antenna coil related to the fourth embodiment.
Figure 11:
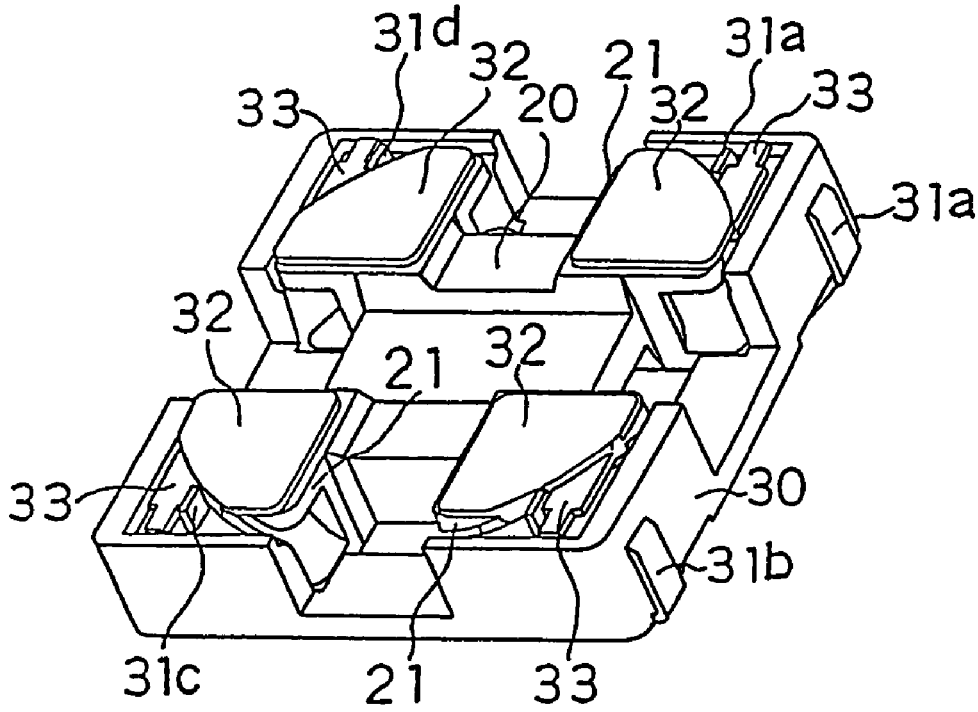
FIG. 11 is a perspective view of a situation where the base component with wound coil in the antenna coil related to the fourth embodiment is set in a case.

FIG. 9 through FIG. 11 depict an antenna coil related to a fourth embodiment. In this antenna coil is a structure whereby wound onto a base component (20) comprising a flat bar are a first coil (5), a second coil (6), and a third coil (12). The first coil (5) is wound so that the X-axis of the base is the axis. The second coil (6) is wound so that the Y-axis of the base is the axis. The third coil (12) is wound so that the Z-axis of the base is the axis. The base component (20) consists of ferrite.

Base (20) has an approximately right-angled parallelepiped configuration. Tabs (21) are provided on the eight corners of this parallelepiped base (20). The flat configuration of the aforementioned tabs (21) are quarter-circled fan shapes. In the surface of base (20) is formed a second groove (22) deepest in the X-axis direction when the base (20) is placed in a flat state. Wound onto this second groove (22) is the second coil (6). The second lateral components (21*b*) of the tabs (21) are arranged facing the lateral wall of the second groove (22).

In the surface of the base component (20) is formed a first groove (23) in the Y-axis direction when the base (20) is arranged in a flat state. Wound onto this first groove component (23) is a first coil (5). The first lateral part (21*a*) of the tabs (21) is arranged to face the lateral wall of the first groove (23). The bases of two tabs (21) arranged such that the flat parts mutually face each other create a third groove (24). The part (21*c*) sandwiched by the planes of the tabs (21) is oriented to form the lateral wall of the third groove (24), whereon the third coil (12) is to be wound.

The second coil (6) is wound on the base (20) formed as discussed above. Then, thereupon is wound the first coil (5) in the orthogonal direction. The third coil (12) can then be wound along the peripheral surface. An antenna coil in this state is then set into a case (30) made of resin, as FIG. 11 depicts.

The case (30) has a configuration of a flat, mainly square bar that, when level, has a disc shaped hole perforated from the upper surface, for example. The aforementioned hole component is large enough to allow the antenna coil FIG. 10 depicts to be positioned. Furthermore, in the two pairs of facing lateral walls in the flat, square-shape bar, notches are made in the centers of the lateral surfaces. In the four corners of the flat square-shaped bars are implanted, on the back side of case (30), terminals (31*a*)-(31*d*) in a flat way such that the ends of one side protrude, while the ends of the other side are pasted to the lateral surface of the case (30).

In a state where a base component (20) whereon are wound a first coil (5), a second coil (6), and a third coil (12) is positioned into the hole component of the aforementioned case (30) (as depicted in FIG. 11, the coils are not wound, but in fact they are), caps (32) made of resin are adhered to the four exposed tabs (21). The caps (32) are approximately identical to the flat-shaped tabs (21), and flat plate-like terminals (33) are provided.

Onto one given terminal (33) are wound one end component of the first coil (5), the second coil (6), and the third coil (12), respectively. The remaining ends of the first coil (5), the second coil (6), and the third coil (12) are wound at a one-to-one correlation onto the three remaining terminals (33). The coil ends, as well as the various terminals (32) and corresponding terminal (31*a*)-(31*d*) protrusions, are soldered together to make electrical connections. The back surface, invisible to the naked eye, of the case (30) in FIG. 11 is solder mounted onto the circuit substrate. The visible surface becomes the top surface.

Figure 12:
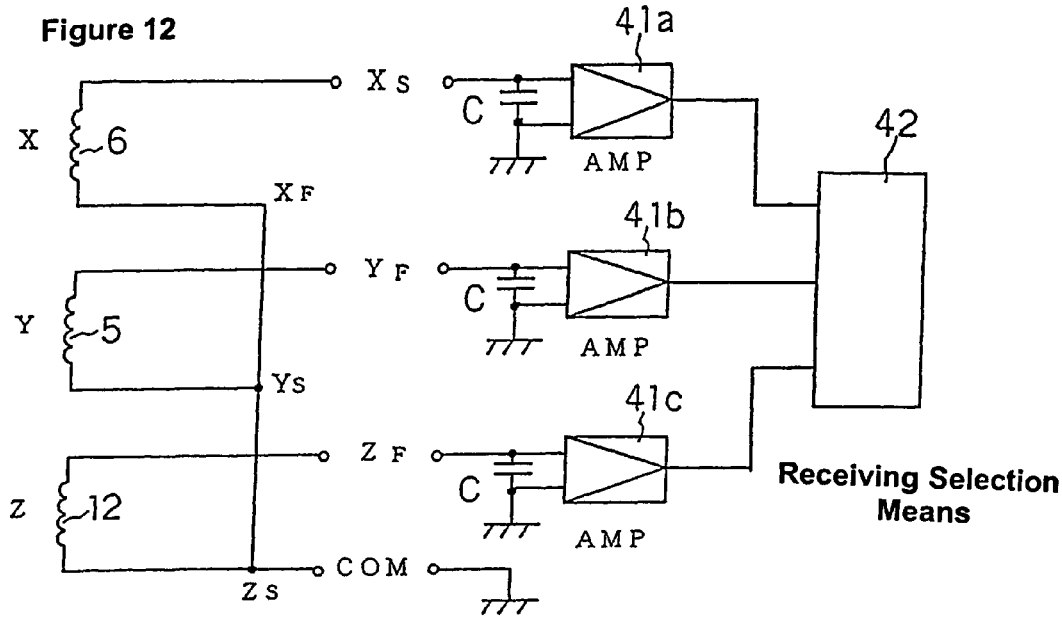
FIG. 12 is a structural diagram of a receptor circuit constructed using the antenna coil related to Embodiment 4.
Figure 13:
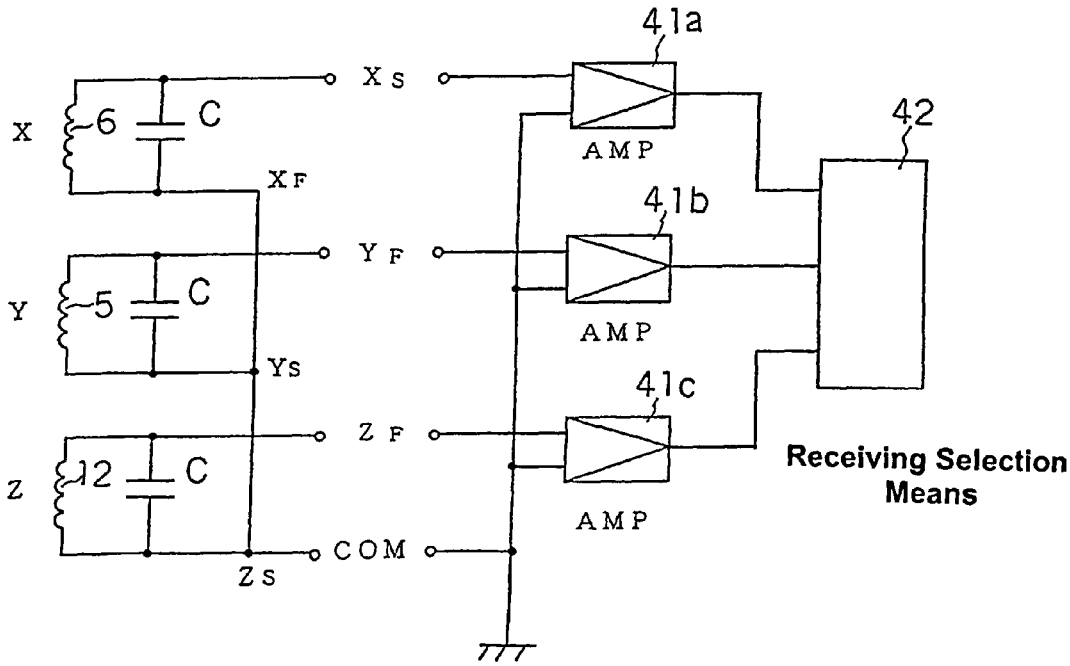
FIG. 13 is a structural diagram of a receptor circuit constructed using the antenna coil related to Embodiment 4.

FIG. 12 and FIG. 13 depict structural examples of receiving circuits constructed using antenna coils related to third and fourth embodiments of the present invention. In the explanation that follows, the suffix "S" denotes the winding start side terminal of a coil. The suffix "F" denotes the winding finish side terminal of a coil. First is an explanation of the structural example of FIG. 12. The winding finish side terminal (XF) of the second coil (6), the winding start side terminal (YS) of the first coil (5), and the winding start side end (ZS) of the third coil (12) are connected to a common terminal (COM). The winding start side terminal (XS) of the second coil (6), the winding stop side end (YF) of the first coil (5), and the winding stop side end (ZF) of the third coil (12) are connected, respectively, to individual terminals. The common terminal (COM) is grounded.

Amps (41*a*)-(41*c*) are provided, with one side of the input terminals of the amps (41*a*)-(41*c*) being grounded. The ungrounded side input terminal of amp (41*a*) is connected to the winding start side terminal (XS) of the second coil (6). The ungrounded side input terminal of amp (41*b*) is connected to the winding finish side terminal (YF) of the first coil (5). The ungrounded side input terminal of the amp (41*c*) is connected to the winding finish side terminal (ZF) of the third coil (12).

The respective condensers (C) are connected between the various grounded side input terminals and ungrounded side input terminals of amps (41*a*)-(41*c*). The various output terminals of amps (41*a*)-(41*c*) are connected to a receiving selection means (42) of a wireless device, etc. The receiving selection means (42) selects the largest signal from among those output from the various output terminals of amps (41*a*)-(41*c*).

The number of loops in the various coils is regulated in the fourth embodiment as well, and the first coil (5), the second coil (6) and the third coil (12) each form an independent tuning circuit. Each tuning circuit is connected to a high frequency amplification circuit (amp [41*a*]-[41*c*]) that is selective in that it chooses the strongest output signal from among the various tuning circuits and amplifies that signal. For the electromagnetic waves incident from the X-axis, the aforementioned high frequency amplification circuit selectively amplifies the output signal of the tuning circuit formed by the first coil (5). For the electromagnetic waves incident from the Y-axis, it selectively amplifies the output signal of the tuning circuit formed by the second coil (6). For the electromagnetic waves incident from the Z-axis, it selectively amplifies the output signal of the tuning circuit formed by the third coil (12). Thus, the fourth embodiment is also capable of creating favorable reception sensitivity to electromagnetic waves incident from the X-axis, the Y-axis and the Z-axis directions.

Following is an explanation of the structural example of FIG. 13. In the structural example of FIG. 12, the condensers (C) are such that the gaps between the respective grounded side input terminals and the respective ungrounded side input terminals of the amps (41*a*)-(41*c*) are connected. In the structural example of FIG. 13, though, condenser (C) is connected parallel to the second coil (6), condenser (C) is connected parallel to first coil (5), and condenser (C) is connected parallel to third coil (12). [sic.].

The respective input terminals on one side of the amps (41*a*)-(41*c*) are commonly connected and grounded. The winding end side terminal (XF) of the second coil (6), the winding start side terminal (YS) of the first coil (5), and the winding start side terminal (ZS) of the third coil (12) are connected to a common terminal (COM) that is then connected to the common connection terminal of the aforementioned amps (41*a*)-(41*c*). In this structure as well, the antenna coil improves reception sensitivity selectively to electromagnetic waves incident from the X-axis, the Y-axis and the Z-axis directions, as with the structure in FIG. 12.

As indicated in the aforementioned FIG. 12 and FIG. 13, the various coil terminals on the antenna coil side are connected to a common terminal. In this case, in the examples in aforementioned FIG. 12 and FIG. 13, the winding stop side terminal (XF) of the second coil (6), the winding start side (YS) of the first coil (5), and the winding start side terminal (ZS) of the third coil (12) are connected to a common terminal (COM). Terminals connectable to the common terminal are, in the second coil (6), terminal XF and terminal XS; in the first coil (5), terminal YF and terminal YS; and in the third coil (12), terminal (ZS) and terminal (ZS). As FIG. 12 and FIG. 13 depict, the example wherein terminals XF, terminal YS, and terminal ZS are selected is denoted by the suffixes FSS, and there are 23=8 [sic.] combinations of any three terminals.

Coding the aforementioned eight suffixes yields SSS, FFF, FFS, FSF, FSS, SFF, SFS, SSF. Testing as to whether any of these eight has suitable reception sensitivity properties is done by measuring frequency properties. As FIG. 12 and FIG. 13 depict, FSS (the example wherein terminal (XF), terminal (YS) and terminal (ZS) are selected) is the most suitable.

Figure 14:
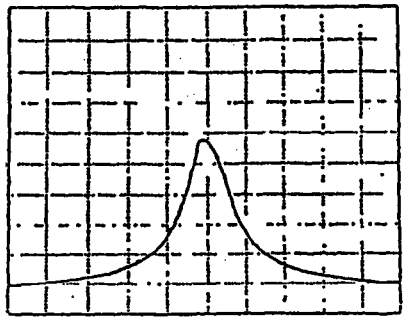
FIG. 14 depicts, in the antenna coil related to Embodiment 4, the frequency properties during optimum connection when one prescribed terminal of each coil are commonly connected.
Figure 14:
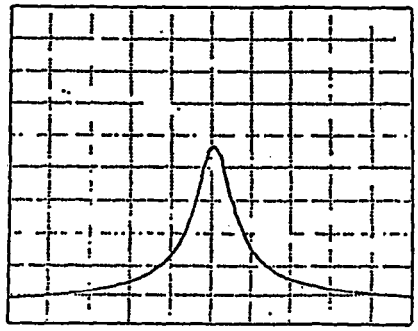
Figure 14:
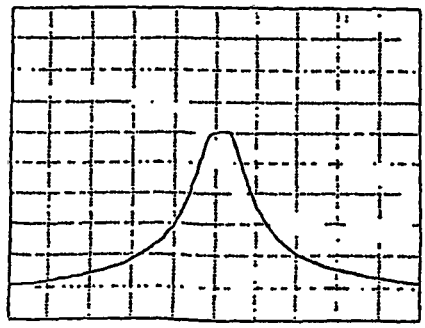

Namely, in an FSS example where the frequency properties to electromagnetic waves incident from the X-axis are indicated on the left side, the frequency properties to electromagnetic waves from the Y-axis are indicated in the middle, and frequency properties to electromagnetic waves incident from the Z-axis are indicated on the right side, the impedance value in the resonance frequency of the graph peaks in FIG. 14 is highest and stable and one can see there are just about the same frequency properties in any axis direction and that the reception sensitivity is good. Furthermore, in the various charts, the vertical axis is impedance. Each grade is 50 KΩ. The horizontal axis is frequency. The center of the horizontal axis is 134.2 KHz. The width of the horizontal axis is 30 KHz. Moreover, the number of loops in each coil is 400. The diameter of the base component (2) is 9 millimeters. The thickness of the thinnest part is 0.9 millimeters. The thickness of the thickest part, including a tab (21), is 2.8 millimeters. The condenser capacity (C) is 200 pF.

Figure 15:
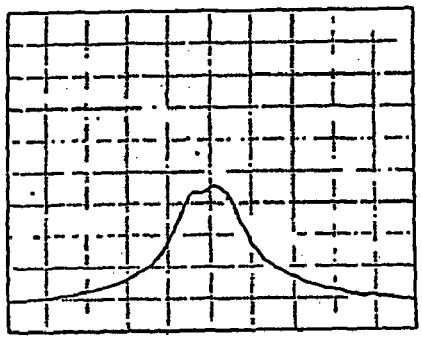
FIG. 15 depicts, in the antenna coil related to Embodiment 4, frequency properties during other than optimum connection when one prescribed terminal of each coil are commonly connected.
Figure 15:
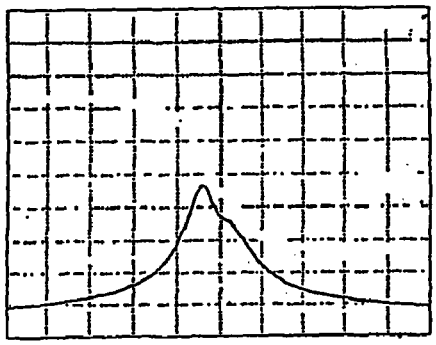
Figure 15:
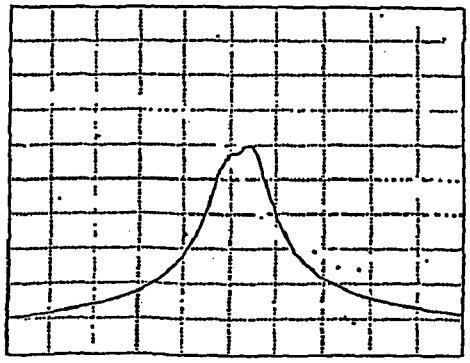

In contrast, in an FSS example as shown, for instance, in FIG. 15, there are dispersions in the resonance frequencies and impedance values to the X-axis, the Y-axis and the Z-axis. Moreover, in the X-axis and Z-axis, there are unsuitable properties such as collapsed peaks caused by interference with other coils. Except for FSS, examples of common connections other than FFS are approximately analogous to FFS, meaning it is difficult to obtain balanced properties in the three axial directions and inappropriate frequency properties are generated.

Figure 16:
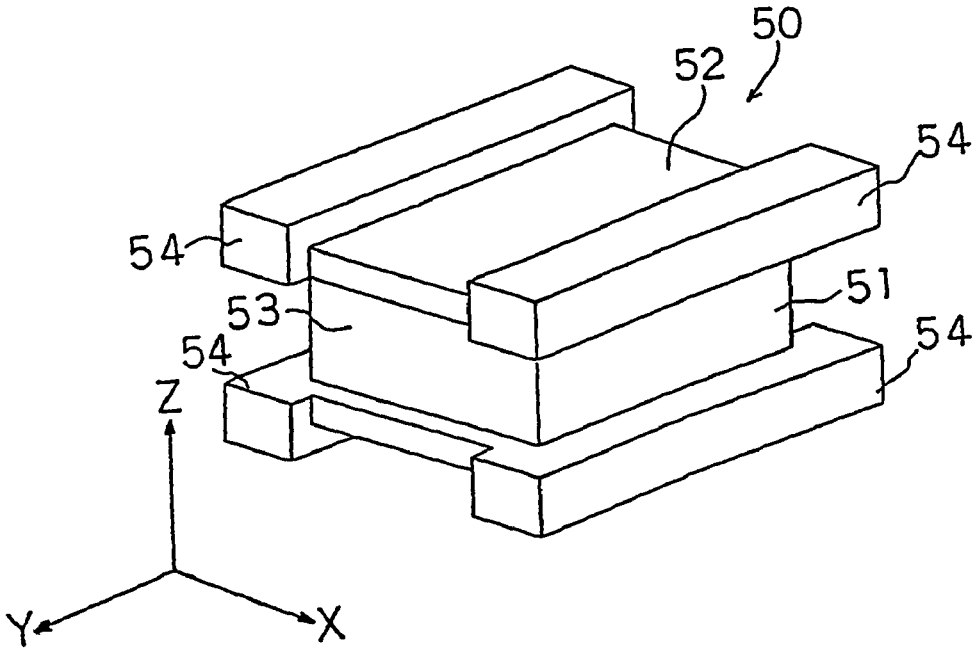
FIG. 16 is a perspective diagram of the base component of the antenna coil related to Embodiment 5.

In the aforementioned explanation, the example depicts tabs (21) provided on a base component (20), but basically a bobbin (50) as found in FIG. 16 can be used. In short, this bobbin (50) has a base component (51) shaped like a flat bar, a first groove (52) to wind the first coil such that the X-axis of the base component (51) becomes its axis, and a second groove (53) to wind the third coil such that the Z-axis of the base component (51) becomes its axis. The four pole-shaped members (54) extending lengthwise along the Y-axis direction of the base component (51) are provided in four areas of the base component. The second coil is wound to intersect these pole-shaped members (54). In short, the second coil is wound such that the winding axis is the Y axis. The first, second, and third coil are not shown in this FIG. 16. In an antenna coil with such a structure, the same effect as the antenna coil in the fourth embodiment is achieved. Furthermore, the ferrite cores (2) in the various embodiments mentioned above can, for example, be changed to cores made of resin. Moreover, the material for the base components (20), (51) is not limited to ferrite. A resin or such can be used as well.

USABILITY IN INDUSTRY

An antenna coil related to the present invention as described above is such that coils are wound in the X-axis and Y-axis directions, or the X-axis, Y-axis and Z-axis directions, of one core and base components. Thus, compared to cases of an antenna coil whereby multiple bar antennas are aggregated, a small-sized item is feasible whereby reception sensitivity to electromagnetic waves incident from three orthogonal directions can be rendered favorable regardless of the antenna coil installation position. Furthermore, one end each of three coils are commonly joined, enabling desirable reception sensitivity.

The invention claimed is:

1. An antenna coil, comprising:

a ferrite base shaped in an approximately right-angled parallelepiped configuration including eight corners;

a tab provided on each of the eight corners of the ferrite base with four pairs of the tabs, the tabs of each pair opposing each other and being a matching pair;

a first groove formed in a surface of the ferrite base parallel to a Y-axis and a first side portion of the tabs;

a second groove formed in the surface of the ferrite base parallel to an X-axis and a second side portion of the tabs;

a third groove formed in a valley between the opposing tabs of each of the four matching pairs;

a first coil wound in the second groove;

a second coil wound in the first groove and over the first coil; and a third coil wound in the third groove along a side portion of the ferrite base, wherein the second groove is deeper than the first groove and the third groove;

wherein an axis about which the second coil is wound and an axis about which the third coil is wound cross are at right-angles with an axis about which the first coil is wound, and wherein a first end component of each of the first, second, and third coils is connected to a common terminal and a second end component of each of the first, second, and third coils is each connected to a different terminal, thereby providing four terminals.

2. The antenna coil of claim 1, wherein a winding end side end component of each of the first, second, and third coils is connected to the common terminal.

* * * * *

UNITED STATES PATENT AND TRADEMARK OFFICE

CERTIFICATE OF CORRECTION

PATENT NO. : 7,755,558 B2
APPLICATION NO. : 11/785510
DATED : July 13, 2010
INVENTOR(S) : Ueda et al.

It is certified that error appears in the above-identified patent and that said Letters Patent is hereby corrected as shown below:

Title page, column 1, below Item (62) and above item (51), insert the following:

--(30) Foreign Application Priority Data
Mar. 5, 2002 (JP) .....2002-58835--.

Signed and Sealed this
Twenty-second Day of March, 2011

David J. Kappos

David J. Kappos
*Director of the United States Patent and Trademark Office*